United States Patent [19]

Prinz

[11] Patent Number: 5,056,342

[45] Date of Patent: Oct. 15, 1991

[54] SECURITY CONTAINER FOR MOUNTING TO AN UNDERSURFACE

[76] Inventor: Robert E. Prinz, 5360 S.W. 82nd Ave., Miami, Fla. 33155

[21] Appl. No.: 543,103

[22] Filed: Jun. 25, 1990

[51] Int. Cl.[5] ..... E05B 65/52

[52] U.S. Cl. ..... 70/63; 5/308; 5/503; 5/508; 109/51; 206/317; 224/912; 248/551

[58] Field of Search ..... 5/503, 508, 308; 70/63, 70/DIG. 81; 206/317; 109/51, 52; 248/551-553; 224/912, 913

[56] References Cited

U.S. PATENT DOCUMENTS

| | | | |
|---|---|---|---|
| 1,806,773 | 5/1931 | Waters | 5/508 X |
| 1,996,414 | 4/1935 | Gantt | 312/226 X |
| 2,662,715 | 12/1953 | McKnight | 5/503 X |
| 3,464,606 | 9/1969 | Nordeen | 224/912 X |
| 3,896,987 | 7/1975 | Soja | 206/317 X |
| 4,309,065 | 1/1982 | Pappas | 224/912 X |
| 4,721,205 | 1/1988 | Burt et al. | 206/317 |
| 4,768,021 | 8/1988 | Ferraro | 70/159 X |
| 4,788,838 | 12/1988 | Cislo | 70/63 |
| 4,807,315 | 2/1989 | Wachenheim | 109/68 X |
| 4,869,449 | 9/1989 | Goodman | 5/508 X |
| 4,877,131 | 10/1989 | Patros et al. | 206/317 |
| 4,890,466 | 1/1990 | Cislo | 70/63 |

FOREIGN PATENT DOCUMENTS

| | | | |
|---|---|---|---|
| 19310 | of 1890 | United Kingdom | 5/308 |

*Primary Examiner*—Lloyd A. Gall

*Attorney, Agent, or Firm*—Malloy, Downey & Malloy

[57] ABSTRACT

A security box or a container assembly designed to be secured to the undersurface of a table, counter, bed frame, or like structure so as to extend beneath the undersurface in a substantially out-of-sight location and specifically adapted to hold a handgun or other applicable weapon, valuables or medication in a readily accessible location for easy removal once a cover of the container is opened. To mount the container under a bed, a mounting structure is removably attached to the bed frame so as to support the container in the preferred out-of-sight location beneath the bed in a somewhat cantilevered fashion. Mounting to other surfaces, such as under a table or counter top can be achieved by securing the top of the container to the mounting surface in such a manner as to be out of the general line of sight.

20 Claims, 4 Drawing Sheets

SECURITY CONTAINER FOR MOUNTING TO AN UNDERSURFACE

BACKGROUND OF THE INVENTION

1. Field of the Invention

This invention relates to a security container specifically designed to be removably mounted to the undersurface of a bed, table or like structure in a somewhat out-of-sight location by attachment to the undersurface wherein the container interior is structured to removably maintain a gun, other weapon or other objects in a preferred, readily accessible location.

2. Description of the Prior Art

Due to an alarming increase in the amount of burglaries, thefts, and other crimes specifically directed at homes or residences, there has been an increase in the amount of hand guns or other weapons maintained in the home for purposes of self-protection. There is, of course, an obvious danger in maintaining loaded hand guns or other weapons in the home. Such danger frequently results in harm or even death to small children or others unauthorized to handle the maintained weapons when such child or unauthorized person has access to them. Therefore, the owner or authorized user of the handgun frequently stores the weapon at a location which is not readily accessible in emergency conditions so as to prevent access thereto by small children or unauthorized persons. This, of course, defeats the purpose of having a handgun in the home since such handgun or like weapon is frequently useless unless the owner or user has quick and ready access thereto.

Since home or residence directed crimes more frequently occur in the evening when the occupants are sleeping, it is an obvious benefit to maintain the handgun at a location which is readily accessible when one is sleeping. accordingly, there is a need in this area for a safety box or security container which will prevent unauthorized access to the handgun but allow the authorized user to reach the handgun, or like weapon, in a quick and efficient manner during emergency conditions such as a break in or the like.

The U.S. patent to Ferraro, No. 4,768,021 is directed to a safe for loaded hand guns which includes a receptacle for containing the weapon which has a bottom providing a mounting surface. A lid is hingedly mounted on the box or safe and is movable between an open and closed condition and further cooperates with a locking device for normally holding the lid in a closed position. The Ferraro device does not include any type of specific mounting structure which readily adapts for secure yet removable support or mounting on the undersurface of a mounting object such that the security box or container is hidden from the general line of sight. Therefore, the safe of Ferraro may be accidentally displaced thereby defeating the purpose of maintaining a handgun in a readily accessible location.

Cislo, No. 4,788,838 discloses a guardian lock box for pistols having a padlocked box secured to an exterior portion of the bed frame and being viewable and readily accessible by virtue of its being mounted on a side wall or surface immediately adjacent to the box springs or mattress. While functional for its intended purpose, the Cislo device has the problem of being readily viewable by small children or other unauthorized personnel unless, for example, the bed is disclosed immediately adjacent to a wall surface. In such condition, opening of the Cislo container would be difficult or impossible.

Wachenheim No. 4,807,315 discloses a waterbed pedestal for supporting a waterbed frame and mattress on its top surface wherein the pedestal includes a cavity which is positioned to extend underneath a waterbed mattress. A safe is positioned in the cavity and secured to the pedestal and includes a removable panel positioned over the front of the cavity to close the cavity and hide the safe. Such safe is primarily directed for the protection of valuables and comprises a secret, hidden security device which is not specifically structured for efficient rapid opening to provide emergency access to a weapon for the protection of the user.

It is assumed that each of the above-noted devices represented in the stated U.S. patent are operative for their intended function. They do not individually or collectively overcome certain problems still existing in this area. There is, therefore, still a need in this area for a security assembly or a container specifically designed to hold a handgun or other weapon (and/or other articles for safekeeping) to prevent unauthorized use by children, burglars or other unauthorized individuals which is mounted in an out-of-the-way location and which is readily attachable but removable from a bed frame in a location that is not visible but efficiently accessible during emergency situations.

SUMMARY OF THE INVENTION

This invention relates to a security container specifically adapted to be mounted to the undersurface of a table, counter, bed frame or other like structures, in a manner which will support and removably dispose the security container in a position beneath the mounting surface where it is not readily visible. The location of the container and its structure cooperate to make a handgun or like weapon, or other valuables, medications, etc., on the interior of the container readily accessible for immediate use in emergency conditions.

In a preferred embodiment, the container includes a hollow interior and a securement structure mounted within the hollow interior which is specifically adapted to removably position a handgun or like weapon or article in a readily accessible position for immediate access. The hollow interior of the container is covered by a lid portion defining a cover means which is movably mounted to a remainder of the container in covering relation to an open face thereof. The open face, when the cover means or lid is disposed in its open or non-covering position, provides immediate access to the interior of the container and any weapon or like object therein.

A lock means comprises a finger operated pad being electrically or otherwise operated and secured to the lid as well as a remainder of the container. The lid may be secured or locked in its closed position relative to the open face but may be readily and quickly opened when the authorized user uses the key pad using a simplified code.

A mounting means is provided so as to removably secure the container to the bed frame below the box spring or mattress in the aforementioned out-of-sight location. The mounting means comprises two brackets each having an elongated mounting arm attached at a common, corresponding end to a head portion. The head portions of each bracket are cooperatively dimensioned and disposed to secure the mounting arms to an L-shaped angle iron portion of a conventional bed frame in a manner which will extend the mounting arms transversely outward from the engaged portion of the bed frame. Further, each of the mounting arms are disposed in somewhat spaced apart yet parallel relation to one another and each are interconnected to one another and to what may be considered an uppermost wall or side of the container. Such connection or attachment occurs by a plurality of somewhat conventional connectors, such as threaded nut and bolt type connectors passing through appropriately aligned apertures in the mounting arm and into an upper wall of the container.

Another feature of the present invention to be described in greater detail hereinafter is the provision of a shield means or structure particularly adapted for use with a handgun when such a handgun is maintained on the interior of the container. The shield is disposed immediately adjacent to and possibly in somewhat surrounding relation to the exit end of the barrel portion. The shield is further disposed in receiving relation to any slug passing from the barrel due to an inadvertent or accidental discharge of the handgun. The shield structure may have a hollow receiving pocket or like chamber and be formed of a high-strength material capable of preventing exiting of the slug from the interior of the container and thereby prevent damage being done to surrounding property or personnel.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 8:
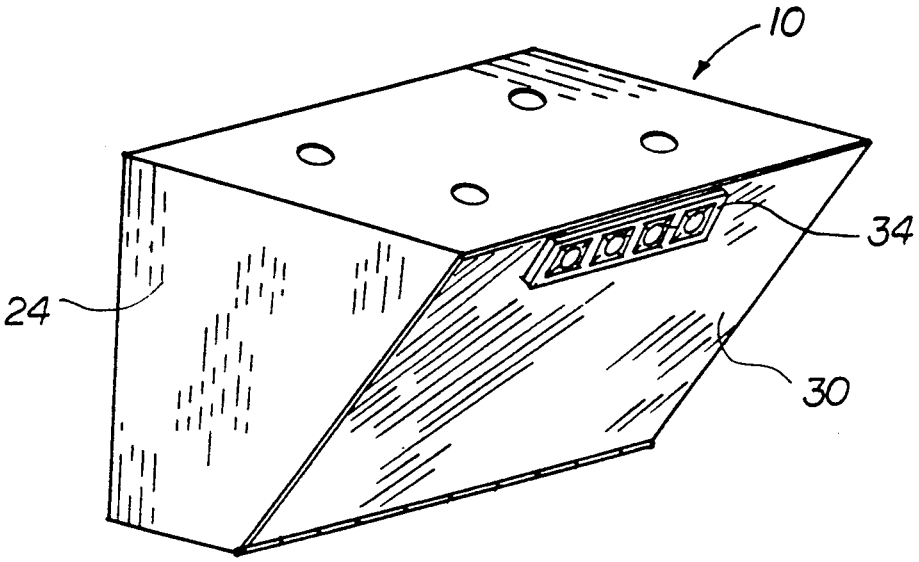
FIG. 8 is a perspective view of the security box of the present invention illustrating a highly reflective finish on a front cover thereof.

As shown in the accompanying drawings, the present invention is directed towards a security box or container assembly generally indicated as 10 and in a preferred embodiment is designed to be removably attached to a bed frame generally indicated as 12 such that the container assembly 10 is supported beneath the mattress and/or box spring structure generally indicated as 14. More specifically, the container assembly 10 is supported in a somewhat cantilevered fashion beneath the undersurface of the mattress and/or bed spring 14 in a somewhat out of the way location. This out of the way location restricts visual detection of the container assembly 10 but yet makes it readily accessible to one lying on the bed. The contents, which may be in the form of a handgun or like weapon or object generally indicated as 16 may be quickly reached during emergency conditions. The container assembly 10 includes an uppermost wall 20 which, when the container assembly 10 is mounted to the bed frame 12, is substantially adjacent to an undersurface of the mattress and/or box spring 14. Other depending sidewalls as at 22, 23, and 24 extend downwardly from the uppermost wall 20. A base portion as at 26 is also provided. The container assembly 10 has a hollow interior as at 28 and an open face 27 which provides access to the interior 28. The open face is selectively covered by a cover means in the form of a lid or like cover member 30 pivotally or otherwise movably attached by a hinge 32 to the container 10 and specifically to the base portion 26. In a preferred embodiment, the cover member 30 includes a, as shown in FIG. 8, mirrored finish on its outer surface adapted to reflect the image of the flooring material below giving a camouflaged appearance wherein the container assembly is not readily visible to a person viewing the underside of the bed or other mounting surface.

Figure 1:
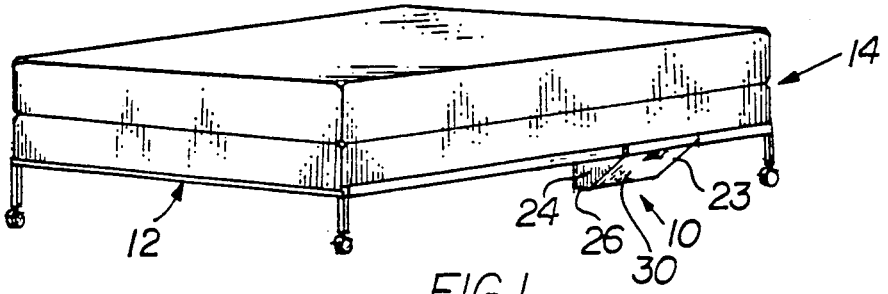
FIG. 1 is a perspective view of the security box of the present invention mounted to the under side of a bed frame in an out of sight manner.
Figure 2:
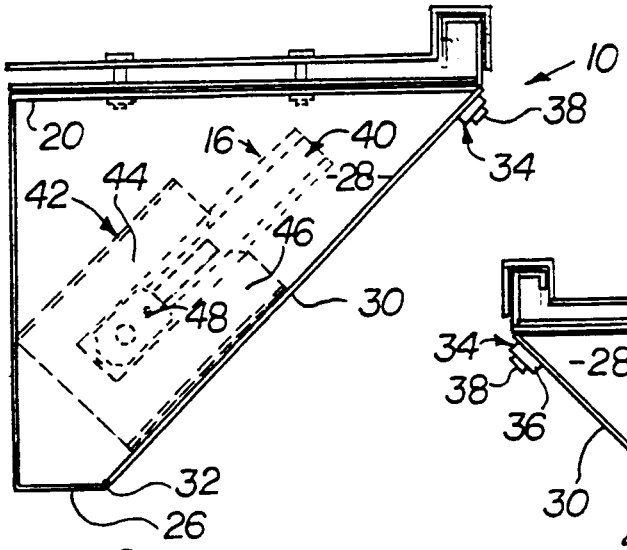
FIG. 2 is a side view in partial section illustrating a handgun positioned within an interior of the container.
Figure 3:
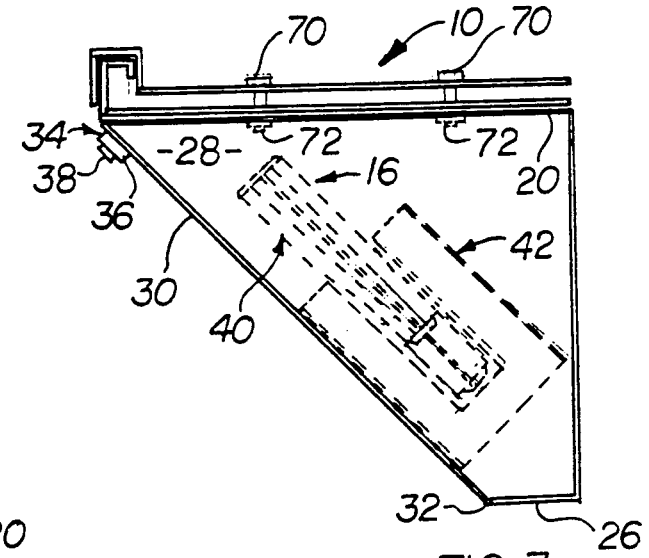
FIG. 3 is an opposite side view of FIG. 2.
Figure 3A:
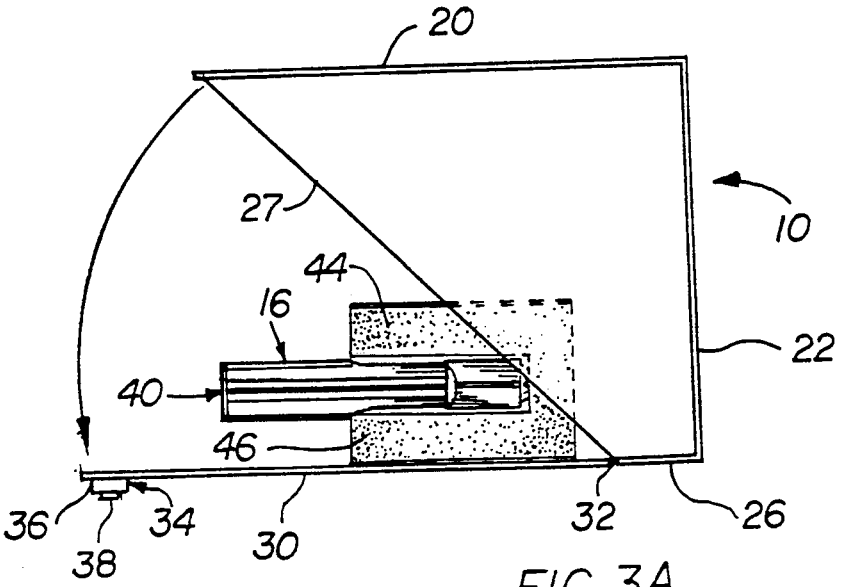
FIG. 3A is a side view illustrating the door of the container in an open position.
Figure 4:
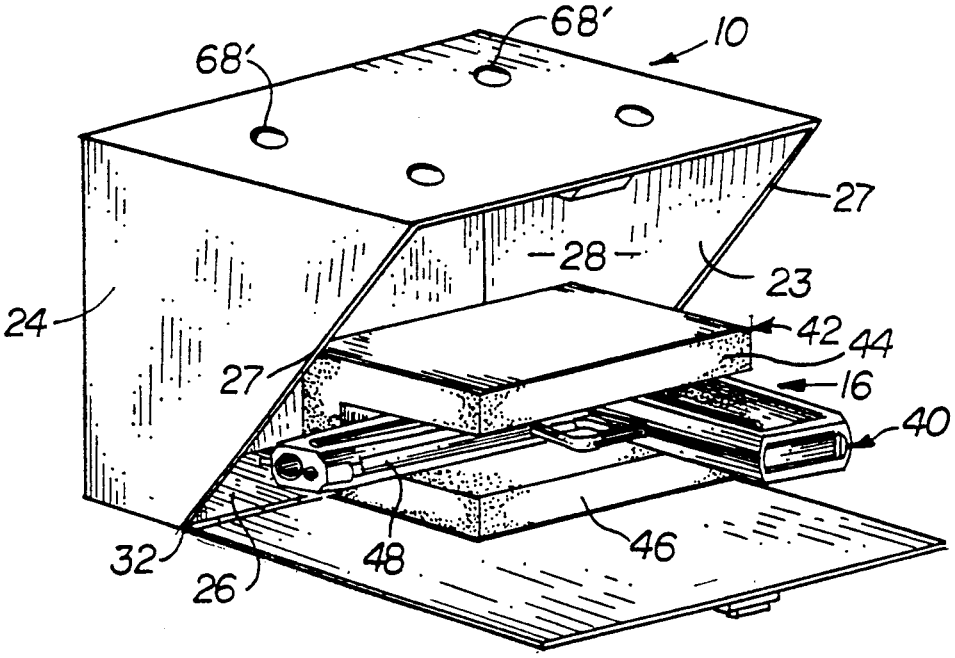
FIG. 4 is a perspective view of a preferred embodiment of the security box of the present invention shown having a handgun removably secured with an interior thereof.
Figure 9:
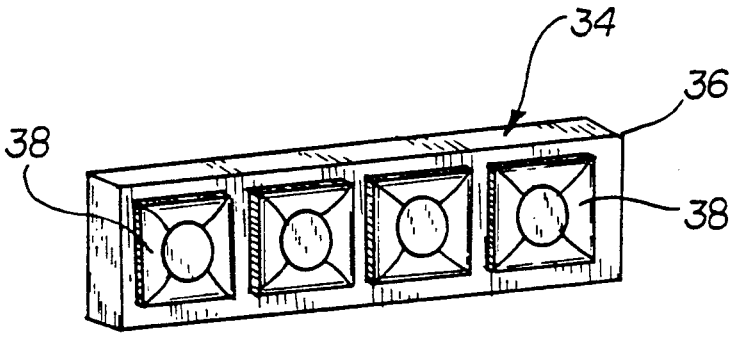
FIG. 9 is an isolated view, shown in perspective, illustrating a combination touch pad of a lock as used in the preferred embodiment of the present invention.

A lock means 34 may be mounted on the lid or cover 30 in a position which is readily accessible. The lock means 34 may be in the form of an electrical or mechanically actuated combination type lock 36 having a plurality of finger pads 38 also exteriorally accessible for manipulation by the fingers of the user, as best illustrated in FIG. 9. A hasp or like member cooperates with any type of latching mechanism of the lock 36 so as to removably maintain the cover or lid 30 in the closed position clearly shown in FIGS. 4 and 5. The closed position is defined by the lid 30 disposed in overlying and covering relation to the open face 27 which provides access to the interior 28 of the container assembly 10.

The interior 28 of the container assembly 10 is designed to hold a weapon or any other applicable object generally indicated as 16. In a preferred embodiment, the weapon 16 is in the form of a handgun 40 which is maintained in a preferred somewhat angular orientation which facilitates quick and efficient gripping and removal thereof from the interior 28 so that it can be immediately used.

Figure 5:
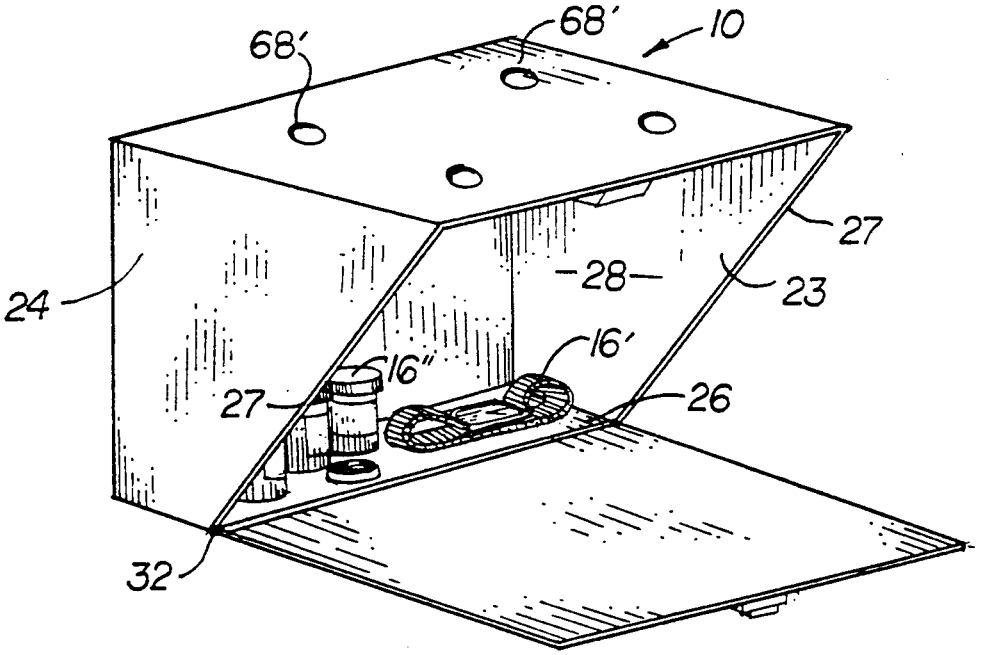
FIG. 5 is a perspective view of an alternative embodiment of the security box shown having jewelry and medication stored with the interior thereof.

In an alternative embodiment, the container assembly 10 is designed to hold jewelry or medication as shown in FIG. 5. Preferably, the jewelry 16' and medication 16'' is positioned within the interior 28 so as to rest on the inner surface of the base portion 26.

In the preferred embodiment, a securement means is generally indicated as 42 and is in the form of two spaced apart pads 44 and 46 preferably formed of a flexible or resilient material and being spaced apart a sufficient distance to allow positioning therebetween of the barrel portion 48 of the handgun 16. The barrel portion 48 is thereby effectively sandwiched and removably "gripped" by the pads 44 and 46. This allows the predetermined, preferred orientation of the handgun 40 for easy access.

In the preferred embodiment, attachment of the container assembly 10 to the under portion of a bed structure 12 is accomplished by a mounting means generally indicated as 52. The mounting means includes a first bracket structure 54 and a second bracket structure 56. Each bracket structure 54 and 56 includes an elongated mounting arm 58 and 60 respectively. Further, the first bracket structure 54 includes a head portion generally indicated as 62. The second bracket structure 56 includes a head portion generally indicated as 64. Both head portions 62 and 64 are structurally adapted and cooperatively dimensioned and configured to be removably attached to a substantially L-shaped angle iron portion 65 of the bed frame 12. Such attachment occurs in a manner which will orient the first and second mounting arms 58 and 60, respectively, in a transversely, outwardly extending, common direction relative to the engaging head portions 62 and 64 and the L-shaped portion 65 of the bed frame. In this operative position, the mounting arms 58 and 56 are disposed in spaced apart and somewhat parallel relation to one another.

Further, each of the mounting arms includes at least one but preferably a plurality of spaced apart apertures 68. When the brackets 52 and 54 are disposed in their operative position in attachment with the L-shaped portion 65, the apertures 68 of each mounting arm 58 and 60 are disposed in aligned relation with one another. Further, each of the apertures are dimensioned to receive substantially conventional connectors such as threaded bolts 70 and receiving nuts 72. Similarly, receiving apertures 68' are formed in the uppermost wall 20 of the container assembly 10 to facilitate the connection of the container assembly 10 to the mounting arms 58 and 60 by virtue of the conventional connectors 70, 72.

Figure 6:
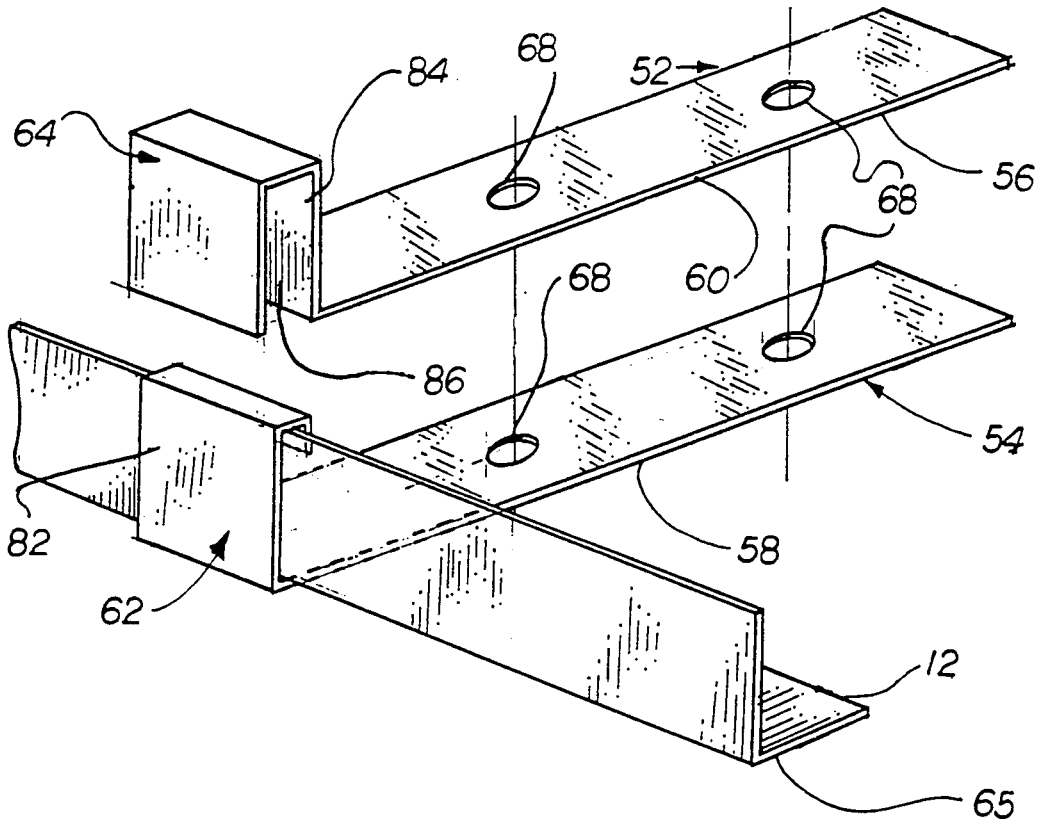
FIG. 6 is a perspective view of a preferred mounting bracket of the present invention.
Figure 7:
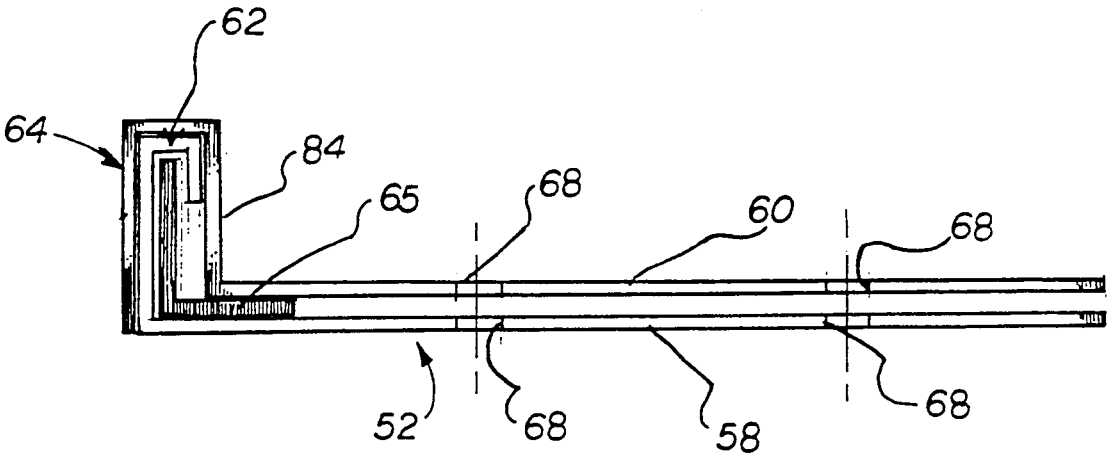
FIG. 7 is a side view of the mounting bracket of FIG. 6.

Retention and support of the container assembly 10 in a somewhat cantilevered fashion beneath the frame 12 and the mattress and/or box spring 14 is in large part due to the structure and configuration of the head portion 62 and 64. More specifically, the head portion 62 includes a substantially U-shaped configuration with the mounting arm 58 secured to and extending outwardly from an outermost wall or leg 82 of the head portion 62. The interior surfaces of the U-shaped head portion 62 confrontingly engage both the upper edge as well as substantially the entire outer surface of the L-shaped portion 65 as best shown in FIG. 6.

The head portion 64 of the second bracket structure 52 defines what may be referred to as a retaining portion. The head portion 64 also has a somewhat U-shaped configuration. The elongated mounting arm 60 is attached to and extends outwardly from an innermost wall or leg 84. The interior as at 86 is dimensioned and configured to fit over in covering relation to the exterior surfaces of the head portion 62 of the first bracket structure 58 and in substantially surrounding and/or enclosing, concentric relation to the L-shaped portion 65 of the bed frame 12. By virtue of the relative disposition of the head portions 62 and 64, the head portion 62 is prevented from inadvertently dislodging from the L-shaped portion 65.

Other applications of the present invention include mounting the container assembly 10 to the undersurface of a table, counter or like structure wherein the uppermost wall 20 is adapted to be mounted directly to the mounting surface on an under side of the mounting object such that the entire container assembly is positioned and oriented so as to be out of the general line of sight.

Now that the invention has been described,

What is claimed is:

1. A security box assembly designed to be mounted t the undersurface of a mounting structure, said assembl comprising:

a container having a hollow interior disposed be tween a top portion and a base portion and an ope face communicating with said hollow interior, cover means movably mounted on said container an positionable into and out of a closed, locked posi tion defined by covering relation to said open face said cover means being positioned and disposed o said container so as to define an at lead partiall angled front portion extending upwardly at an a lead partially angled orientation from an oute edge of said base portion to an outer edge of sai top portion in such a manner so as to be angle away from a line of sight, mounting means secured in supporting engagmen with said top portion of the container for mountin the container to the undersurface of the mountin structure in such a manner so as to position an support the container in a substantially out-of-sigh location entirely beneath the mounting structure, locking means secured to said container for maintain ing said cover means in said closed, locked posi tion, and including release means structured t release said locking means to allow movement o said cover means between said closed, locked posi tion and an open position permitting access to sai hollow interior, said front portion including a highly reflective finis on an outer surface thereof being adapted to mirro an appearance of an underlaying surface so as t effectively camouflage the container.

2. An assembly as in claim 1 wherein said lockin means comprises an electronic combination lock struc tured and disposed to lockingly interconnect said cove means to said container in said closed, locked position

3. An assembly as in claim 2 wherein said electroni combination locking includes a said release means com prising a combination touch pad, said release mean being structured to release said locking means so as t allow movement of said cover means between sai closed, locked position and said open position upo entering a predetermined combination on said combina tion touch pad.

4. An assembly as in claim 2 wherein said electroni combination lock includes plurality of operating but tons arranged in a linear configuration being positione and disposed to readily receive each of the users finger simultaneously for quick entry of a numbered combina tion.

5. An assembly as in claim 1 wherein the container i adapted to be removably mounted to a bed frame.

6. An assembly as in claim 5 wherein said mountin means including a first and a second bracket structur including a first elongated mounting arm and a secon elongated mounting arm, respectively, said first an second mounting arms secured to one another and sai container and each bracket structure including a hea portion secured to respective ones of said first and sec ond mounting arms and removably attachable to th bed frame.

7. An assembly as in claim 6 wherein each of sai elongated mounting arms extend outwardly from th frame in spaced, parallel relation to one another and a substantially aligned, parallel relation to an undersurface of a bed structure resting on the frame.

8. An assembly as in claim 7 wherein each of said elongated mounting arms include a plurality of spaced part apertures disposed in aligned relation to one another and each of said apertures dimensioned to receive a connector therethrough, each connector secured to an upper wall of said container in supported engagement therewith.

9. An assembly as in claim 7 wherein said head portion of each bracket structure is structurally adapted to be removably attached to an L-shaped portion of the bed frame.

10. An assembly as in claim 9 wherein said head portion of both said first and second bracket structures each comprise a substantially U-shaped configuration, said first elongated mounting arm secured to and extending transversely outward from an inner most ledge of said U-shaped configuration of a corresponding head portion of said first bracket and said second elongated mounting arm secured to and extending transversely outward from an outermost leg of said U-shaped head portion of said second bracket structure.

11. An assembly as in claim 10 wherein aid head portion of said second bracket structure is dimensioned and configured for converging, substantially concentric position relative to both said head portion of said first bracket structure and the L-shaped portion of the bed frame.

12. An assembly as in claim 9 wherein said head portion of said first bracket structure is configured and disposed in confronting engagement with both an upper edge and an outer surface of the L-shaped portion, said head portion of said second bracket structure defining a retaining portion disposed in covering, substantially enclosing relation to said head portion of said first bracket structure.

13. An assembly as in claim 12 wherein said retaining portion comprises a transverse, substantially U-shaped configuration dimensioned to cover said head portion of said first bracket structure.

14. An assembly as in claim 13 wherein said first and second elongated mounting arms extend transversely outward from respective ones of said head portions thereof in cantilevered support of said container.

15. An assembly as in claim 14 wherein each of said elongated mounting arms include a plurality of spaced apart apertures disposed in aligned relation to one another and each dimensioned to receive a connector therethrough.

16. An assembly as in claim 15 wherein the plurality of connectors are secured to an upper wall of said container in supported engagement therewith.

17. An assembly as in claim 1 further comprising securement means mounted within said hollow interior and structurally adapted to removably secure a barrel portion of a handgun therein.

18. An assembly as in claim 17 wherein said securement means comprises two spaced apart pads each formed of a flexible material and disposed for retaining engagement with the barrel portion.

19. An assembly as in claim 17 wherein said securement means is disposed and structured to orient the handgun in a predetermined, readily accessible position within the interior of said container.

20. An assembly as in claim 1 wherein said locking means is structured so as to be operable without the need of direct viewing or light.

* * * * *